US007565711B1

(12) United States Patent
Schamadan

(10) Patent No.: US 7,565,711 B1
(45) Date of Patent: Jul. 28, 2009

(54) COMBINATION FIREFIGHTING TOOL

(76) Inventor: Michael William Schamadan, 13053 N. 14th Way, Phoenix, AZ (US) 85022

( * ) Notice: Subject to any disclaimer, the term of this patent is extended or adjusted under 35 U.S.C. 154(b) by 34 days.

(21) Appl. No.: 11/893,403

(22) Filed: Aug. 15, 2007

Related U.S. Application Data

(60) Provisional application No. 60/838,791, filed on Aug. 17, 2006.

(51) Int. Cl.
*B25D 1/00* (2006.01)

(52) U.S. Cl. ..... 7/145

(58) Field of Classification Search ..... 7/143, 7/145, 147, 158, 159, 161; D8/76, 81, 105
See application file for complete search history.

(56) References Cited

U.S. PATENT DOCUMENTS

| | | | | | |
|---|---|---|---|---|---|
| 1,875,612 | A * | 9/1932 | Johnson | 7/161 |
| 2,017,369 | A * | 10/1935 | McGhee | 7/161 |
| 3,623,173 | A * | 11/1971 | Hagqvist | 7/145 |
| 3,837,023 | A * | 9/1974 | Spencer-Foote | 7/145 |
| 3,888,535 | A * | 6/1975 | Rosso | 294/19.1 |
| 4,208,793 | A * | 6/1980 | Sinnott | 30/299 |
| 4,308,628 | A * | 1/1982 | Kunberger et al. | 7/145 |
| 5,315,724 | A | 5/1994 | Trujillo et al. | |
| 5,507,051 | A * | 4/1996 | Mazon | 7/116 |
| 6,385,854 | B1 | 5/2002 | Sisco | |
| 6,397,420 | B1 * | 6/2002 | Roxton | 7/145 |
| 6,568,016 | B1 * | 5/2003 | Hoogland | 7/145 |
| 6,798,348 | B1 * | 9/2004 | Wilker et al. | 340/691.1 |
| 6,944,955 | B2 * | 9/2005 | Skrivan et al. | 30/308.1 |
| 7,143,459 | B2 * | 12/2006 | Petzl | 7/145 |

* cited by examiner

*Primary Examiner*—David B Thomas
(74) *Attorney, Agent, or Firm*—Gregory J. Nelson

(57) ABSTRACT

A firefighting demolition tool having an elongate pole as a handle. The upper end of the pole carries a head with a piercing point. The sides of the head have teeth for sawing. A hook projects from the head for tearing away material and which may also be an arresting hook. The lower end of the pole has a base which may be used for hammering or battering when in a position normal to the pole. The base may also be pivoted to a position in which it is aligned with the pole and in this position may be used for operations such as sawing and prying.

6 Claims, 3 Drawing Sheets

COMBINATION FIREFIGHTING TOOL

CROSS REFERENCE IS MADE TO RELATED APPLICATION

This application is based on U.S. Provisional Patent Application Ser. No. 60/838,791, filed Aug. 17, 2006, of the same title.

FIELD OF THE INVENTION

The present invention relates to a firefighting tool and more particularly relates to a combination firefighting tool with which the firefighter can perform multiple operations such as hammering, chopping, sawing, piercing, battering and other operations when fighting a structural fire.

BACKGROUND OF THE INVENTION

In the course of fighting a fire, firefighters frequently find it necessary to gain entry into buildings or exit through walls or doors in emergency situations by breaking away sections of the structure. Firefighters must also often create ventilation openings or chimneys in structures to vent the fire in the course of performing their duties. These and other operations often require the use of various firefighting tools such as pike poles, axes, hammers, saws and other devices.

Gaining entry into or seeking an exit from a building may require a firefighter pry away structural components. Providing openings in walls or ceilings for entry or exit or for ventilation may require hammering action or require walls or structural components be hammered or chopped. Hammering is also required for breaking out windows and doors.

One common tool used by firefighters to perform operations, as mentioned above, is termed a "pike pole." A pike pole has an elongate shaft or handle with a sharpened, piercing end which may be used to create openings in walls and ceilings. The traditional pike pole also has a hook-shaped arm that is spaced inward from the piercing end and may be used to engage walls and ceilings and pry away sections of the walls or ceiling.

Because of the various operations described above and the various situations firefighters may encounter, it may be necessary for firefighters to have access to an assortment of tools such as hammers, pry bars and pike poles, as described, to effectively combat fires. It is not always possible for a firefighter to be equipped with the various tools necessary to carry out the operations mentioned above. Even if a firefighter enters a building with several tools, it is often necessary for a firefighter to select a tool and place the unused tool in an out-of-the-way location. If the immediate task requires a different tool, the firefighter must change tools which is time-consuming and may be difficult in the course of fighting the fire due to heat fire, smoke and debris conditions. As a result, various combination firefighting tools have been developed over the years.

U.S. Pat. No. 5,315,724 shows a combination fire axe which includes an elongate handle having a head member disposed at one end of the handle and pike member at the opposite end. The head member includes a base secured to the handle with a cutting portion having a convex edge disposed on one side of the base. An enlarged end portion having a blunt face is disposed on the opposite side of the base. The pike member includes a base portion secured to the handle and a wedge-shaped pike end portion and a hook member extending outwardly from the pike member.

U.S. Pat. No. 6,385,854 shows a firefighting tool intended for making a hole in the ceiling. The tool includes a body, a hook and a handle. The body has a first terminal end and a second terminal end. The hook has a working area and is disposed on the first terminal end of the body and pierces ceilings. The handle is pivotally mounted to the second terminal end and extends perpendicularly outward from both sides of the body.

Another example of the tool of this type is found in U.S. Pat. No. 3,921,288 which teaches a wrecking tool for piercing wall and ceiling surfaces for enabling easy removal of sections thereof.

U.S. Pat. No. 4,208,793 relates to a firefighting device for breaking holes in ceilings, walls and the like. A battery and cutting edge extends downwardly from the pointed tip and a horizontal bottom blade extends perpendicular to the axis of an adaptor which is attached to the blade portion and to a pole for gripping by the firefighter.

U.S. Pat. No. 5,095,623 teaches a firefighting tool having a flat blade with a pointed leading end for piercing through structural panels. A plurality of stop teeth members are provided for engaging the structural that has been pierced.

U.S. Pat. No. 5,542,183 relates to a firefighter's tool which includes a base shaft within which telescoping expandable tubular sections are stored. A retractable power cord extends through the tubular sections to a motor mounted on the distal end of the outermost telescoping section.

From the foregoing it will be apparent that various wrecking and demolition tools have been developed and are shown in the prior art to assist firefighters in fighting fires. Some of these tools are combination tools which can be used to perform various functions. While these various tools may be suitable for particular purposes, there nevertheless exists a need for a combination tool which can be used by a firefighter to selectively perform a number of functions and which tool is efficient in its design and use.

BRIEF SUMMARY OF THE INVENTION

Briefly, the present invention provides a firefighting tool having a handle in the form of an elongate pole. The upper end of the pole has a head with a sleeve which receives the upper end of the pole. The sleeve has a plurality of teeth along one or more sides which can be used for operations such as sawing. The upper end of the sleeve tapers to a pike or piercing point having multiple faces. A hook projects from the head terminating at a downwardly depending projection. One or more sides of the hook are also provided with teeth which may be used for sawing. The hook may be used to pull down material or may be used as an arresting hook which a firefighter may use to engage a structural member to slow or stop a firefighter from sliding or falling in an emergency situation.

The lower end of the pole carries a baseplate which is pivotally secured to the pole and with the baseplate positioned normal to the pole, the base can be used to batter or ram. The baseplate has a polygonal peripheral edge and selected of the edge surfaces may be provided with teeth. The base may also be pivoted to a position in which the planar or lower surface is aligned with the axis of the pole. In this position, the base may be used to saw or pry away structural components such as walls, roofing material, ceiling panels and the like.

A tether strap is positioned on the pole below the head and provides a loop which the firefighter may grasp when performing certain operations such as hammering or pounding using the base. The strap also will facilitate carrying the tool.

Accordingly, the tool of the present invention is a multifunctional tool which will increase the efficiency and effectiveness of the firefighter enabling the firefighter to perform multiple firefighting operations using a single tool.

BRIEF DESCRIPTION OF THE DRAWINGS

The above and other advantages and objects of the present invention will become more apparent from the following description, claims and drawings in which:

DETAILED DESCRIPTION OF THE DRAWINGS

Figures 1, 2, 3:
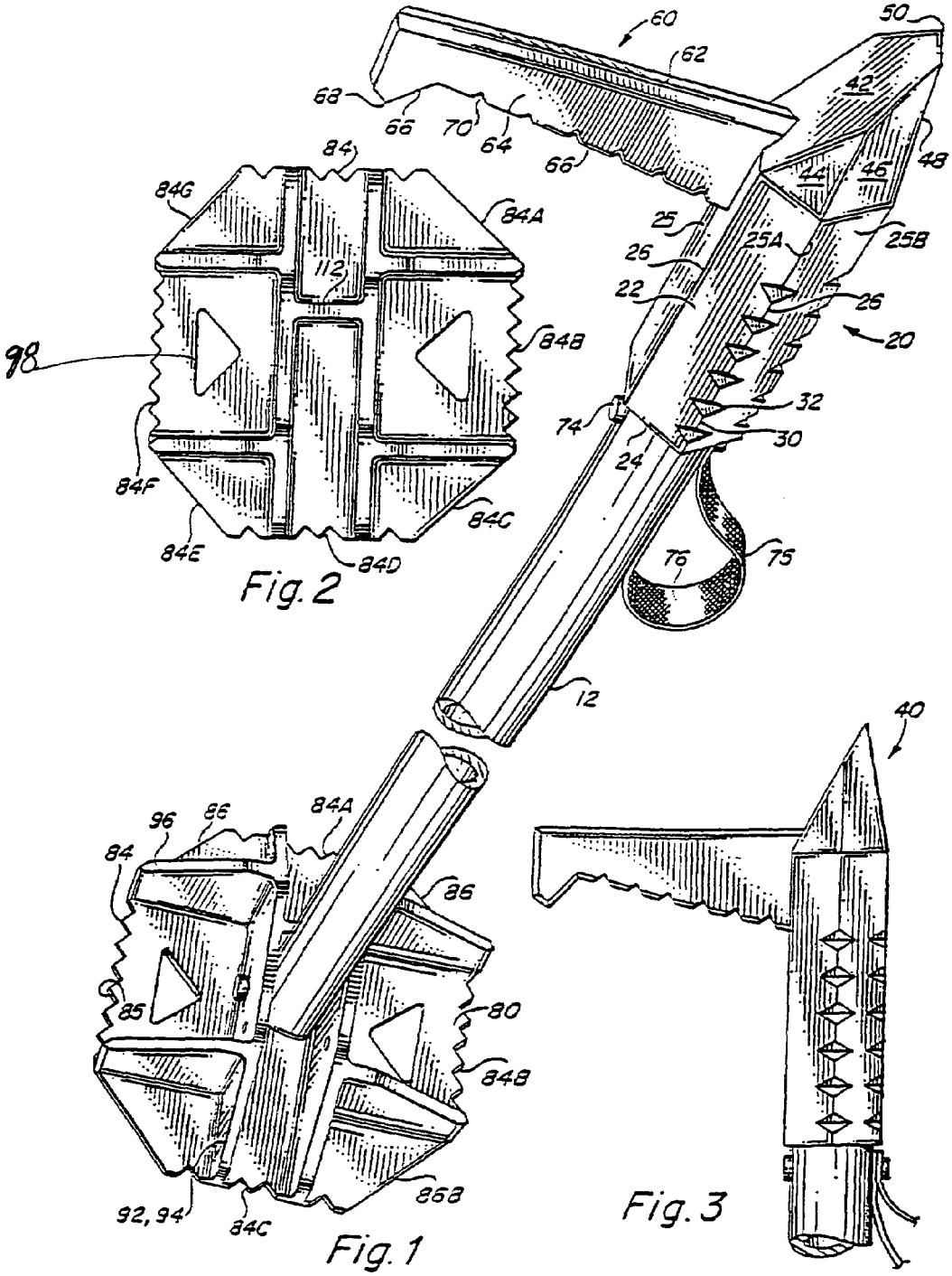
FIG. 1 is a perspective view of the firefighting tool of the present invention.
FIG. 2 is a plan view of the base of the tool of the present invention.
FIG. 3 is a side view of the head end of the tool of the present invention.

Referring now to the drawings, the tool of the present invention is generally designated by the numeral 10 and includes an elongate handle or shaft 12. The elongate pole may be any suitable length. The length should be convenient for use, transportation and storage during periods of non-use. The pole may be any suitable material such as wood, a lightweight metal such as aluminum or preferably a strong composite material or fiberglass.

The upper end of the pole carries a head 20 which is fabricated from hardened steel or similar material. The head 20 has a sleeve 22 which defines an interior bore 24 which receives the upper, distal end of the pole 12. The head may be attached to the pole by any conventional means such as use of mechanical fasteners, bonding or even by means of a friction fit.

The outer surface of the sleeve is polygonal having a plurality of generally planar faces 25, 25A, 25B, etc. These faces extend generally axially and edges 26, 26A, 26B extend between the faces. One or more of these edges such as axially extending edges 26A and 26B are provided with a plurality of teeth 30 which teeth are defined by a plurality of spaced-apart grooves or notches 32 provided in the edges. The teeth may be formed by milling or grinding operation. The edges 26A, 26B in which the teeth are formed to be used for sawing and similar operations.

A tip 40 extends from the upper end of the sleeve. The tip 40 is defined by a plurality of converging faces 42, 44, 46, 48, etc. The generally planar faces converge at a point 50 so that the upper end of the tool can be used as a pike for piercing and breaking operations.

An arm 60 projects generally perpendicularly or normal to the axis of the pole 12 having its inner or base end attached to face 42 and sleeve surface 25. The arm 60 has an upper edge 62 and a lower edge 66 which has a plurality of teeth 64. The lower edge 66 of the blade tapers or converges outwardly terminating at a projected hook 68. The projecting hook has a point 70 and a plurality of teeth 72 are formed in the lower edge of the blade.

The arm 60 is used or manipulated so that the hook engages the structure so that the structure may be broken or torn away. The arm also serves as an arresting arm in case a firefighter slips or loses his or her balance. In this event, the hook may be used to engage a structural member to interrupt a fall or stabilize the individual so that the individual does not continue to fall or slip.

A strap 75 of a suitable material such as leather or plastic material forms a loop 76 and is secured to the pole just below the sleeve. The strap may be secured by conventional fastener 78 extending into or through the pole 12.

The lower or base end of the pole 12 carries a base 80. The base 80 is fabricated from a suitable steel material and has a generally planar bottom surface 82. The base 80 is polygonal and, as shown, has eight sides 84 through 84G with surface 84, 84B, 84D and 84F having a plurality of teeth or serrations 85, 85A, 85B, 85C. The serrated edges are arranged rectilinearly with tapered sides 84A, 84C, 84E and 84G extending between the edges which carry the teeth. The opposed edge sections 84, 84B, 84D and 84F can be used to saw or chop through material and the tapered sides will facilitate entry of the base into a structural component when used to chop or tear.

The base 80 is pivotally secured to the lower end of the pole 12. The pole is received spaced between two parallel channels 92, 94. Ribs 96 extend outwardly from the channel to the opposite edges 95, 95A. The channels 92, 94 will reinforce and strengthen the base 80. Relieved areas 98 may be provided in the baseplate to reduce weight.

Figure 4:
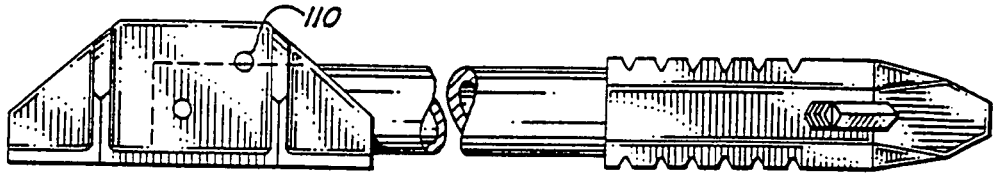
FIG. 4 is a side view of the tool of the present invention shown in a position with the base pivoted to a use-position in which the surface of the base is aligned with the axis of the pole.

A pair of bores 100, 102 are provided in the channels 92, 94. Bore 100 is disposed at a central location along the channels and receives a pivot pin 104 which extends through an aligned bore in the lower end of pole 12. As best seen in FIG. 4, second bore 102 is also provided in the channels 92, 94 disposed above bores 102. Thus, when the pole is pivoted to a position overlying the baseplate as shown in FIG. 4, a pin 112 can be inserted into aligned bores 110 so that the tool can be secured for use or storage in the position shown in FIG. 4.

If the user wishes to orient the pole in a vertical position with respect to the base, the pin can be removed, the pole pivoted upwardly until the pole contacts intermediate rib 112 extending between the channels 92, 94. In this position, a pin 112 can then be reinserted into the bore 110 locking the pole in the vertical position.

Figure 7:
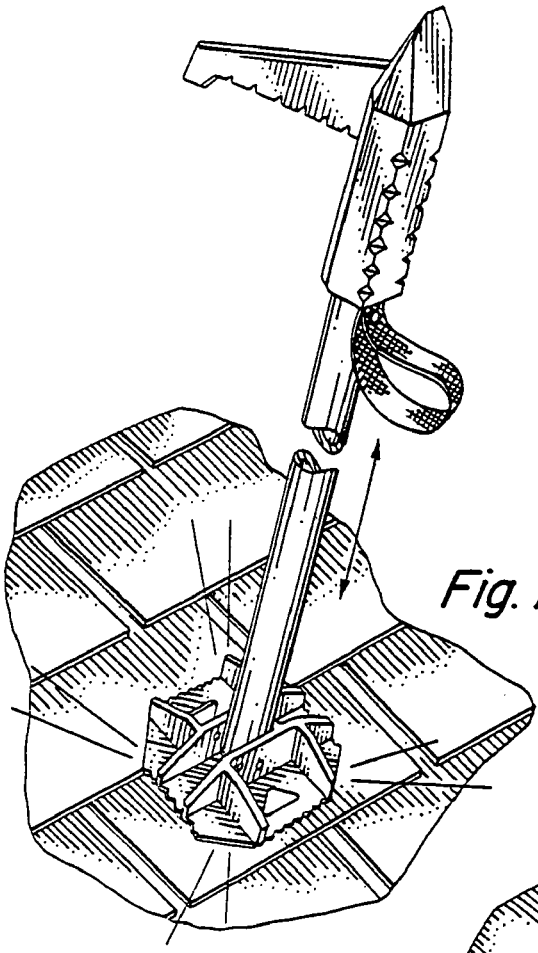
FIG. 7 is a perspective view showing the tool of the present invention being used with the base positioned with the surface of the base generally normal to the pole and functioning in a hammering, pounding or battering operation.
Figure 8:
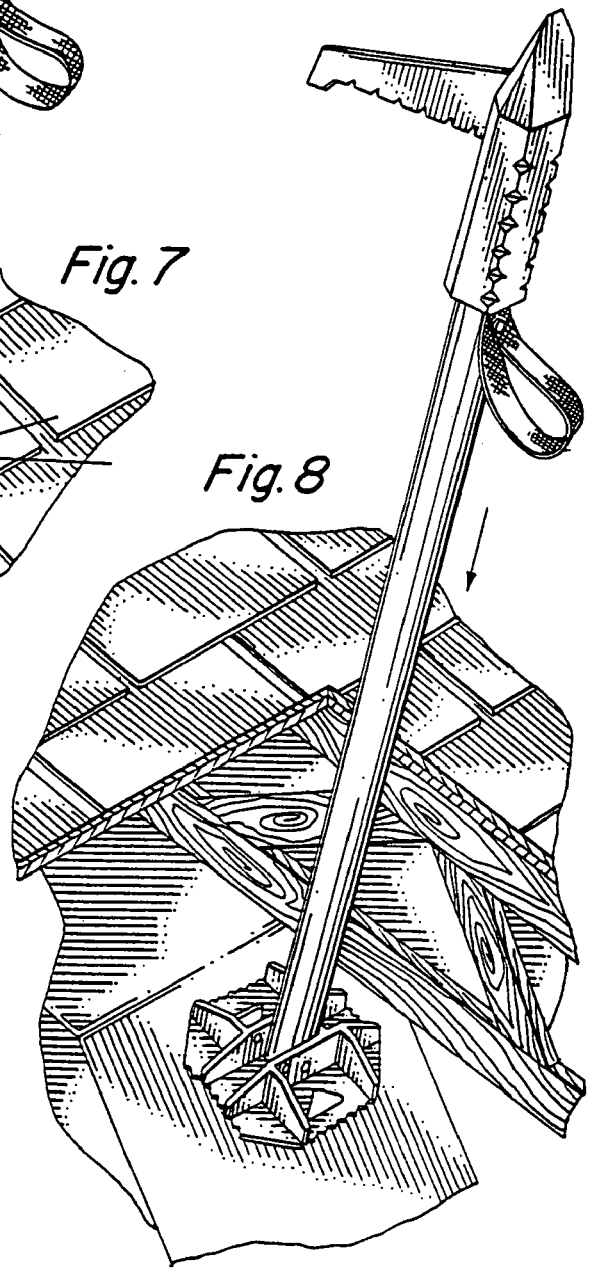
FIG. 8 is a view similar to FIG. 7 showing a portion of the structure being broken away by the hammering, pounding and battering operation.

The tool of the present invention may be conveniently stored when not in use and the stored position would normally be as shown in FIG. 4 with the base aligned with the pole. In use, the tool may be used for a wide variety of operations encountered in firefighting. As shown in FIGS. 7 and 8, the user may wish to position the base normal to the lower end of the pole. The pole can be locked relative to the base as described above using pin 112. In this position, the device can be used to punch or batter a surface such as when breaking through a roof to provide ventilation. The user can repeatedly batter the area by grasping the pole or grasping the pole and the loop 70. Repeated blows will cause the material to breakaway as shown in FIG. 8.

Figure 9:
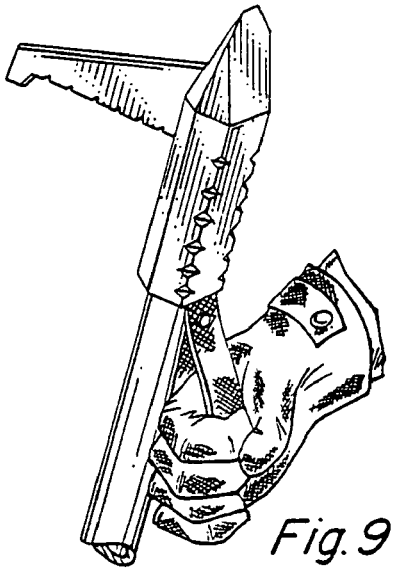
FIG. 9 shows the upper end of the tool and attached strap with the strap being grasped by the hand of a firefighter.

In FIG. 9, a firefighter is shown grasping the loop 70 and the head of the tool may then be thrust upwardly or outwardly to pierce through a structural member. The projecting arm can be used to engage material to pull it away.

Figure 5:
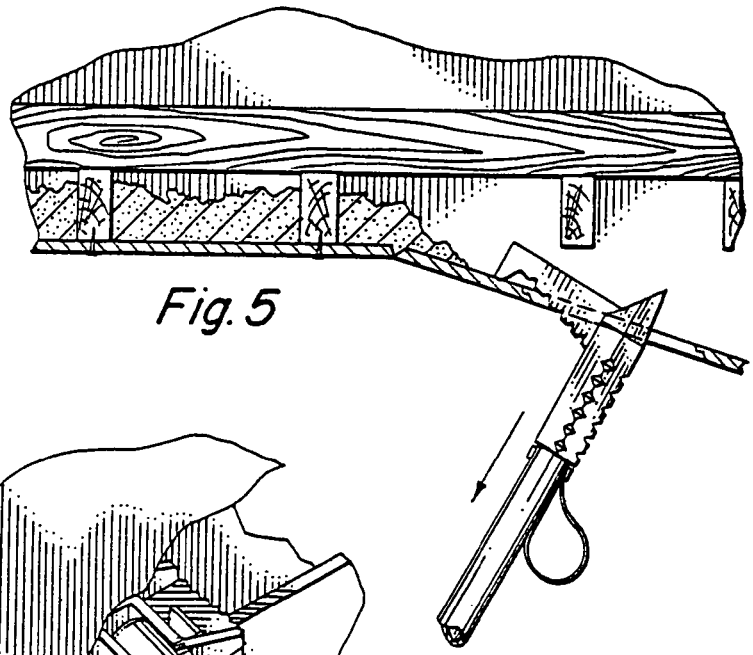
FIG. 5 is a view showing the head end of the tool of the present invention being used in a manner to pry or pull-away structural components such as ceiling tiles.
Figure 6:
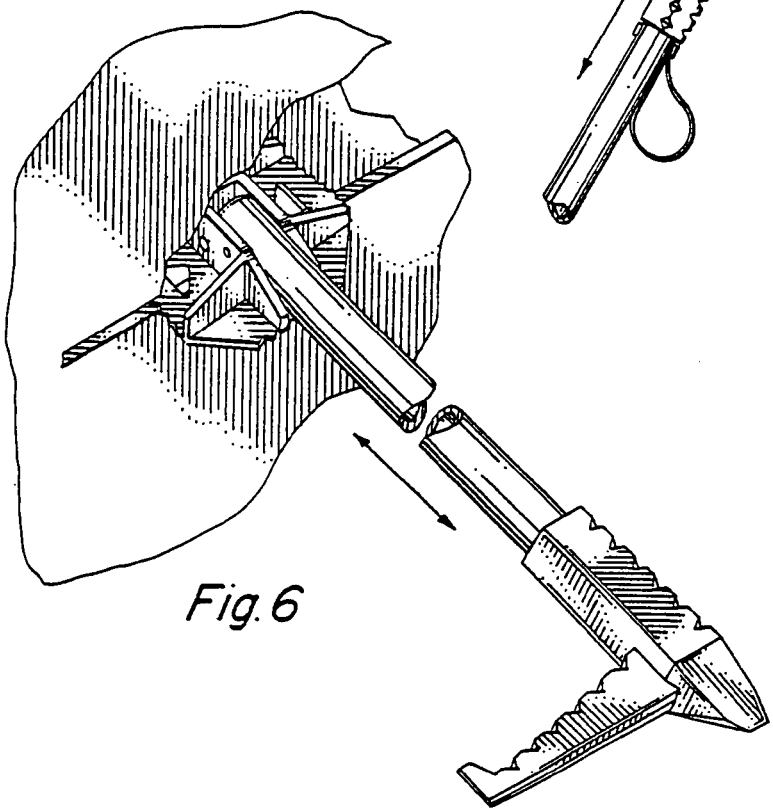
FIG. 6 shows the tool of the present invention in a position as shown in FIG. 4 used with an edge of the base being used to chop or breakaway material.

In FIG. 5, the tool of the present invention is shown in a position in which the pike or piercing end has been used to penetrate a ceiling. The user may then exert a downward force which will cause the hook on the end of the arm to engage the material and disengage the material from the wood and rafters.

Also, as mentioned above, the hook may be used by a firefighter to engage a structural member to stabilize the firefighter or prevent slipping or falling.

The various sections of the head and base each carry teeth which may be used for sawing through materials. Sawing operations may be accomplished by using the teeth on the head or on the base. The base may be oriented in either of the use positions described above when sawing.

From the foregoing it will be seen that the present invention provides a very efficient and effective firefighting tool which a firefighter can use to perform a wide variety of operations such as prying, piercing, hammering, tearing away material and the like.

It will be obvious to those skilled in the art to make various changes, alterations and modifications to the invention described herein. To the extent such changes, alterations and modifications do not depart from the spirit and scope of the appended claims, they are intended to be encompassed therein.

I claim:

1. A firefighting tool comprising:

(a) an elongated handle having opposite first and second ends;

(b) a head converging to a pointed tip having a sleeve secured to said first end, said sleeve having a plurality of faces intersecting at axially extending edges;

(c) a plurality of notches axially spaced apart along at least one of said edges;

(d) an arm having a top and bottom surface, said arm extending laterally from said head terminating at a hook; and (e) a base pivotally attached to the second end of said handle, said base having a plurality of peripheral side edges, at least one of said side edges defining a plurality of teeth.

2. The firefighting tool of claim 1 wherein said base has a pair of spaced-apart ribs with a space therebetween which receives the second end of the handle and a removable pivot pin extending through said ribs and handle.

3. The firefighting tool of claim 1 wherein said arm defines a plurality of teeth extending along the bottom surface thereof and wherein said hook extends downwardly from said arm.

4. The firefighting tool of claim 1 further including a loop attached to said handle adjacent said head.

5. The firefighting tool of claim 1 wherein said base has four side edges generally perpendicular to one another with angular edges extending between adjacent said side edges.

6. The firefighting tool of claim 1 wherein said base defines an area relieved of material.

* * * * *